US005290213A

United States Patent [19]

Sheikowitz

[11] Patent Number: 5,290,213

[45] Date of Patent: Mar. 1, 1994

[54] WEIGHT BENCH INCLINE SEAT SUPPORT DEVICE

[75] Inventor: Jeff Sheikowitz, Florida, N.Y.

[73] Assignee: Legacy International, Inc., Florida, N.Y.

[21] Appl. No.: 28,908

[22] Filed: Mar. 8, 1993

[51] Int. Cl.[5] ..... A63B 21/078

[52] U.S. Cl. ..... 482/104; 482/142

[58] Field of Search ..... 432/17, 38–42, 432/104, 133, 142

[56] References Cited

U.S. PATENT DOCUMENTS

| | | | |
|---|---|---|---|
| 2,470,815 | 5/1949 | Harvey | 482/104 X |
| 2,960,701 | 11/1960 | Nawara . | |
| 4,286,782 | 9/1981 | Fuhrhop | 482/104 X |
| 4,306,715 | 12/1981 | Sotherland | 482/104 |
| 4,582,319 | 4/1986 | Lowa | 482/104 X |
| 4,635,930 | 1/1987 | Cormier | 482/104 |
| 4,637,608 | 1/1987 | Owens et al. . | |
| 4,655,448 | 4/1987 | Harder . | |
| 4,932,654 | 6/1990 | Batea . | |
| 4,936,572 | 6/1990 | Desiderio . | |
| 4,974,839 | 12/1990 | Cantor | 482/104 |
| 5,184,992 | 2/1993 | Banks | 482/104 |

FOREIGN PATENT DOCUMENTS

| | | | |
|---|---|---|---|
| 705803 | 5/1941 | Fed. Rep. of Germany | 482/38 |
| 2579107 | 9/1986 | France | 482/38 |
| 2065482 | 7/1981 | United Kingdom | 482/104 |

*Primary Examiner*—Robert Bahr

*Attorney, Agent, or Firm*—Frank P. Presta

[57] ABSTRACT

Weight bench apparatus including a pair of spaced vertically extending barbell support arms, a bench seat positioned between the support arms having a back portion which is constructed to pivot between a plurality of incline positions, and a horizontally extending seat back support bar which is constructed to extend between and connect with the barbell support arms in different vertically spaced positions to selectively support the back portion in a plurality of incline positions. The support bar is constructed to enable the length thereof to be adjusted to vary the distance between the barbell support arms. Preferably, the seat back support bar includes a hollow outer bar member, an inner bar member which slidably fits in the outer bar member in telescoping relation therewith, and a locking member for locking the inner and outer bars together in desired relative positions. The support bar may include downwardly extending nipple members on each end thereof which are receivable in apertures in vertically spaced support bar receiving members that are secured to the barbell support arms.

6 Claims, 1 Drawing Sheet

WEIGHT BENCH INCLINE SEAT SUPPORT DEVICE

TECHNICAL FIELD

The present invention relates to a weight bench device and, more particularly, to a new and improved support device for supporting a weight bench seat at a plurality of different incline positions.

A desirable feature of a weight bench is the ability of the bench to be used for a variety of different exercises so that a more complete workout can be achieved. One common way in which a weight bench can be used to perform different exercises is to construct the seat portion of the bench so that it can be angled to various incline positions. The use of an incline bench has become particularly popular on weight benches of the type used for performing a bench press exercise. By performing the bench press or other similar exercise while seated on a bench at various incline positions, greater muscle building and toning can be achieved. Another desirable feature of weight benches is the ability to adjust the distance between the barbell support arms to enable the arms to support barbells of various lengths and weights.

Owing to the fact that large amounts of weight are often lifted on such benches, it is important for the lifter's safety that the means for supporting the incline bench seat is strong and reliable. The means for supporting the incline seat needs also to be quickly and easily movable to various heights to enable the angle of inclination of the seat to be changed without disrupting the user's workout. In addition, the incline bench support must be able to support the incline seat while the barbell support arms are spaced from each other at various distances.

Therefore, a need has been created for a safe, reliable and efficient incline seat support device which can easily be used to support a weight bench seat at a plurality of incline positions. The incline seat support device of the present invention meets this need.

BRIEF DESCRIPTION OF THE RELATED ART

Various weight bench incline seat support devices are known in the art as evidenced by the U.S. patents to Desiderio U.S. Pat. No. 4,936,572 and Batca U.S. Pat No. 4,932,654.

The patent to Desiderio discloses a weight bench having an adjustable incline seat and seat support means which is operable to support the seat in a plurality of different incline positions. The seat support means includes a plurality of holes in the barbell support arms thereof and an elongated bar which is constructed to extend between the barbell support arms and be received in the holes, thereby providing support for the incline seat. While this type of seat support construction does provide support for the incline seat, it has a number of disadvantages. The bar is subject to shifting within the holes which could result in a safety hazard for the user. Another problem with this construction is that the ends of the bar must extend outwardly beyond the barbell support arms which is also a safety hazard. Moreover, there is not provided a means for increasing and decreasing the distance between the barbell support arms to accommodate barbells of different lengths.

The patent to Batca discloses a weight bench seat support device which includes a pair of U-shaped support bar receiving members secured to the barbell support arms and a support bar which is constructed to rest in the receiving members. Similarly, the construction of this type of support is also subject to shifting because there is nothing provided for securing the bar in the receiving members. Also, the length of the support bar cannot be adjusted to vary the distance between the barbell support arms.

The new and improved weight bench incline seat support device of the present invention was developed to overcome the disadvantages of the known seat supports hereinbefore described.

SUMMARY OF THE INVENTION

Accordingly, it is a primary object of the present invention to provide a new and improved weight bench having a seat support device which safely and effectively supports an incline bench seat in different incline positions.

A more particular object of the present invention is to provide a support device for a weight bench wherein the length of the support bar can be adjusted to vary the distance between the barbell support arms of the bench.

Another object of the invention is to provide an incline seat support device which includes a hollow outer bar member and an inner bar member which is slidably mounted inside the outer bar member in telescoping relation therewith, and means for locking the inner and outer bar members together at a desired position to form a seat support bar having a length which corresponds to the desired distance between the barbell support arms.

A further object of the invention is to provide a plurality of support bar receiving members on each of the barbell support arms for receiving the ends of the support bar, wherein each of the receiving members preferably includes an aperture therein, and the ends of the support bar each include a nipple member extending downwardly therefrom and being receivable in the adjacent aperture.

Yet another object of the invention is to provide a seat support bar that can be adjusted in length through the use of a plurality of alignable holes in the inner and outer bar members, and a pin member for selective insertion in the aligned holes for locking the bar members together in a desired length.

DESCRIPTION OF THE DRAWING

Other objects and advantages of the subject invention will become apparent from a study of the following specification when viewed in light of the accompanying drawing, in which.

DETAILED DESCRIPTION

Figure 2:
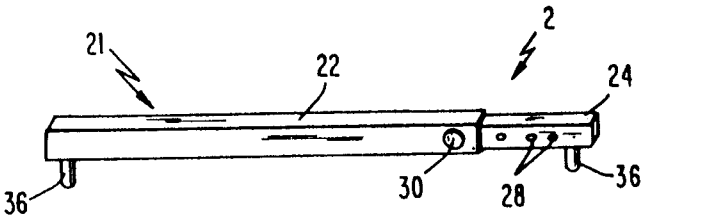
FIG. 2 is a front elevational view of the incline seat support bar of the present invention in an extended position.
Figure 3:
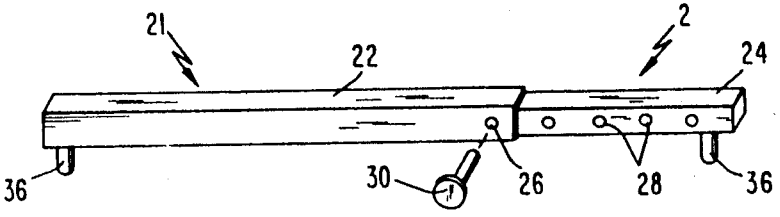
FIG. 3 is a front elevational view of the incline seat support device of FIG. 2 in a retracted position.

Referring now to the drawing, in which like reference numerals designate similar parts throughout the various views, there is shown the weight bench incline seat support device 2 of the present invention. The support device 2 is constructed for use on a weight bench 4 of the type having a pair of spaced vertical extending barbell support arms 6*a* and 6*b*. The barbell support arms 6*a* and 6*b* include barbell holders 8*a* and 8*b* on the upper ends thereof for receiving and supporting a conventional barbell (not shown). Preferably, the barbell holders 8*a* and 8*b* are vertically adjustable on the barbell support arms 6*a* and 6*b* in any suitable manner such that a barbell (not shown) can be supported thereon at various heights.

A bench seat 10 is positioned between the barbell support arms 6*a* and 6*b*. The seat 10 is supported by a first bar 12 which extends longitudinally under the seat 10 and has one end thereof secured to a front leg member 14. A second bar 16 is secured between the two barbell support arms 6*a* and 6*b* near the lower ends thereof. The other end of the support bar 12 is secured to a midportion of the second bar 16, thereby providing a support structure for the seat 10. The second bar 16 also stabilizes and holds the barbell support arms 6*a* and 6*b* in desired vertical spaced positions. Preferably, the second bar 16 includes means for enabling the length thereof to be increased and decreased, thereby enabling the distance between the barbell support arms 6*a* and 6*b* to be varied to accommodate barbells of various lengths and weights. The second bar 16 preferably is of telescoping construction. It may be of any other suitable construction which enables the length thereof to be selectively changed.

The seat 10 includes a substantially horizontally supported main seat portion 18 and a seat back portion 20 which extends between the barbell support arms 6*a* and 6*b*. The seat back portion 20 is pivotally connected with the main seat portion 18 by suitable hinges or the like to enable the seat back portion 20 to be pivoted to a plurality of different incline positions relative to the main seat portion 18.

The support device 2 is constructed to selectively support the seat back portion 20 in different incline positions. The support device 2 comprises a support bar 21 extending between and operable to connect with the barbell support arms 6*a* and 6*b* at a desired height thereon. Depending on the particular height at which the support bar 21 is connected, the seat back portion 20 will be supported at a particular angle of inclination. In accordance with the invention, the support bar 21 is constructed to enable the length thereof to be increased and decreased to selectively vary the distance between the barbell support arms 6*a* and 6*b*.

Preferably, the support bar 21 includes a hollow outer bar member 22 and an inner bar member 24 which is slidably mounted within the outer bar member 22 in telescoping relation therewith. By sliding the inner bar member 24 inwardly or outwardly relative to the hollow outer bar member 22, the overall length of the support bar 21 can be selectively changed to vary the distance between the barbell support arms 6*a* and 6*b*. A locking means is provided for locking the inner and outer bar members 22 and 24 in desired relative positions to maintain the support bar 21 in a desired length. Preferably, the locking means includes at least one hole 26 in the outer bar member 22 and a plurality of holes 28 in the inner bar member 24 which can be selectively aligned with the outer bar member hole 26. A pin member 30 is constructed to be inserted in the aligned holes, thereby securely locking the support bar 21 in the desired length. The holes may be threaded holes, and the pin may have cooperating threads to enable the pin to be threaded or screwed into the holes.

To facilitate connection of the support bar 21 to the barbell support arms 6*a* and 6*b*, the barbell support arms are each provided with at least one support bar receiving member 32 which is constructed to receive and support the ends of the support bar 21. Preferably, a plurality of receiving members 32 are provided at various heights on each of the barbell support arms 6*a* and 6*b*, to enable the seat back portion 20 to be supported at various angles. Preferably, the receiving members 32 are secured to and extend inwardly from the inner side portions 34 of the barbell support arms 6*a* and 6*b*, respectively. One set of the receiving members 32 may be positioned at a height which will enable the seat back portion 20 to be supported in a horizontal position.

Figure 5:
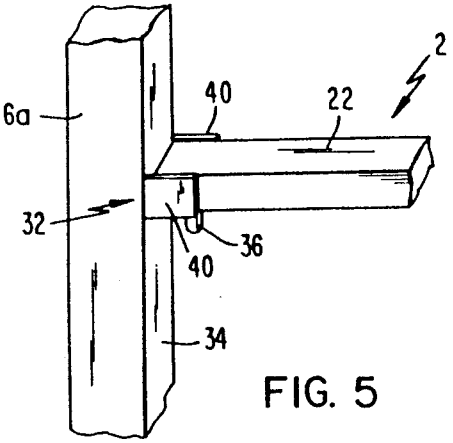
FIG. 5 is a partial perspective view of the support bar positioned in the support bar receiving member of FIG. 4.
Figure 4:
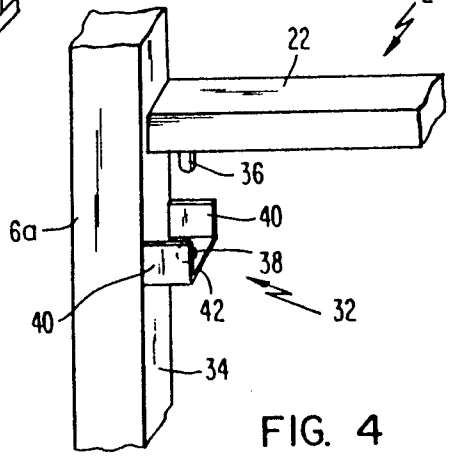
FIG. 4 is an enlarged partial exploded view in perspective of the support bar and a support bar receiving member.
Figure 1:
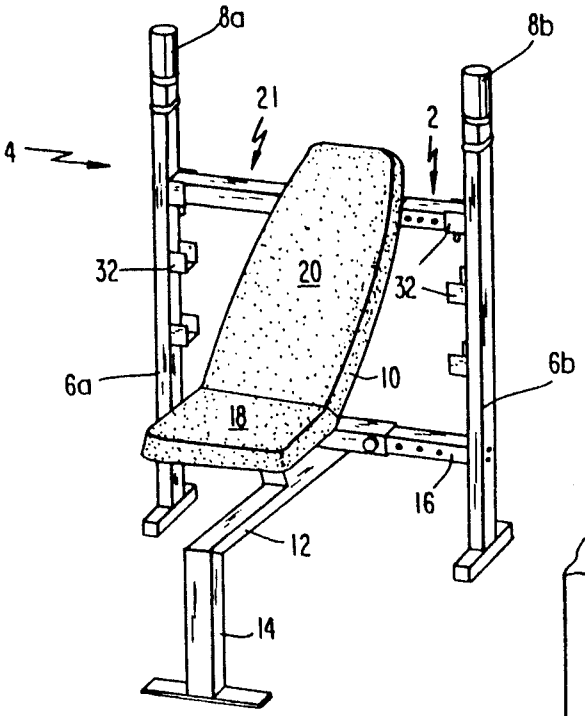
FIG. 1 is a perspective view of a weight bench apparatus constructed in accordance with the present invention.

The support bar members 22 and 24 each include a nipple member 36 adjacent the outer end thereof. As shown most clearly in FIG. 4, each of the support bar receiving members 32 preferably includes an aperture in the lower surface 38 thereof for receiving the nipple members 36 therein, respectively. By providing the cooperating apertures 38 and nipple members 36, the support bar 21 is securely held in the receiving members, and thereby provides a safe and effective support for the seat back portion 20. In the preferred embodiment shown in FIGS. 4 and 5, the receiving members 32 include a horizontally extending bottom wall 42 and a pair of vertically extending side walls 40. Preferably, the aperture 38 is in the bottom wall 42, and the nipple members 36 extend downwardly from the support bar 21, such that when the ends of the support bar 2 are received in the receiving members 32, the nipple members 36 extend downwardly through the apertures 38, respectively.

Preferably, the barbell support arms 6*a* and 6*b*, the seat support members 12, 14, 16 and the seat back support bar 21 are all made of steel with an electrostatic powder paint finish to resist chips and scratches, but any other suitable material which can safely support the desired weight may be used.

While in accordance with the patent statute, the preferred forms and embodiments of the invention have been illustrated and described, it will be apparent to those of ordinary skill in the art that various changes and modifications may be made without deviating from the inventive concepts set forth above.

I claim:

1. Weight bench apparatus, comprising:

a) a pair of spaced substantially vertically extending barbell support arms, b) a bench seat positioned between said support arms having a back portion which is constructed to move between a plurality of incline positions, c) a substantially horizontally extending seat back support bar which is constructed to extend between and releasably connect with said support arms in a plurality of vertically spaced positions to selectively support said back portion in a plurality of desired incline positions, said support bar having vertically extending pins at each end thereof, d) at least one U-shaped support bar receiving member attached to each of said vertically extending barbell support arms in a generally horizontal relationship, each U-shaped support bar receiving member having an aperture on a bottom face thereof for receiving one of said pins of said support bar; and e) means for selectively varying the horizontal distance uniformly between said support arms and for varying the length of said support bar.

2. Apparatus as defined in claim 1, wherein said support bar comprises an elongate, hollow, outer bar member and an elongate inner bar member slidably mounted in said outer bar member in telescoping relation therewith, and means for selectively locking said inner and said outer bar members together in a plurality of relative positions to enable the length of said support bar to be selectively varied.

3. Apparatus as defined in claim 2, wherein said locking means includes at least one hole in said outer bar members, a plurality of holes in said inner bar member spaced along the length thereof, said plurality of holes in said inner bar member being selectively alignable with said hole in said outer bar member, and a locking pin member which is constructed to be received in said aligned holes for locking said inner and said outer bar members together in desired relative positions.

4. Apparatus as defined in claim 2 wherein said means for selectively varying the horizontal distance uniformly between said support arms and for varying the length of said support bar further comprises said support bar having a first elongate hollow outer bar member and a first elongate inner bar member slidably mounted in said outer bar member in telescoping relation therewith, a bench seat support bar assembly interconnecting said support arms having a second hollow outer bar member and a second elongate inner bar member slidably mounted in said second outer bar member, and means for selectively locking said first inner and said first outer bar members together in a plurality of relative positions to enable the length of said support bar to be selectively varied and for selectively locking said second inner and said second outer bar member together to enable the horizontal distance between the support arms to be selectively varied.

5. Apparatus as defined in claim 4, wherein said locking means includes at least one hole in each of said first and second outer bar members, a plurality of holes in each of said first and second inner bar members spaced along the length thereof, said plurality of holes in each of said first and second inner bar members being selectively alignable with a respective said hole in said first and second outer bar members, and locking pin members, each of which being constructed to be received in said aligned holes for locking said first and second inner and outer bar members together in desired relative positions.

6. Apparatus as defined in claim 1, wherein each of said barbell support arms includes a plurality of support bar receiving members vertically spaced along the length thereof, thereby enabling said support bar to be mounted thereon in different vertically spaced positions to selectively support said back portion in a plurality of different incline positions.

* * * * *